United States Patent [19]

Ehrhardt et al.

[11] 4,347,282

[45] Aug. 31, 1982

[54] CHEMICAL CARBONLESS COPY PAPER AND TRANSFER MEDIUM THEREFOR

[75] Inventors: Gerry H. Ehrhardt, West Des Moines; Gene D. Carlson, Ankeny, both of Iowa

[73] Assignee: Frye Copysystems, Inc., Des Moines, Iowa

[21] Appl. No.: 160,724

[22] Filed: Jun. 18, 1980

Related U.S. Application Data

[63] Continuation-in-part of Ser. No. 34,030, Apr. 27, 1979, abandoned, Ser. No. 34,130, Apr. 27, 1979, abandoned, and Ser. No. 34,131, Apr. 27, 1979, abandoned.

[51] Int. Cl.[3] ..... B41M 5/22; B41M 5/16

[52] U.S. Cl. ..... 428/320.4; 106/21; 106/31; 427/150; 427/151; 427/152; 428/320.2; 428/320.6; 428/321.1; 428/484; 428/488; 428/537; 428/914; 282/27.5

[58] Field of Search ..... 106/14.5, 21, 31, 270, 106/271, 272; 282/27.5; 427/144, 150–153, 261, 288, 398; 428/307, 323, 411, 484, 486, 488, 537, 913, 914, 320.2, 320.4, 320.6, 320.8, 321.1

[56] References Cited

U.S. PATENT DOCUMENTS

| | | | |
|---|---|---|---|
| 2,890,124 | 6/1959 | Mange | 106/23 |
| 2,890,125 | 6/1959 | Mange | 106/23 |
| 3,163,548 | 12/1964 | Stark | 106/23 |
| 3,672,935 | 6/1972 | Miller et al. | 282/27.5 |
| 3,894,168 | 7/1975 | Brochett et al. | 428/537 |
| 3,941,608 | 2/1976 | Ehrhardt et al. | 106/32 |
| 4,063,754 | 12/1977 | Shackle et al. | 282/27.5 |
| 4,096,314 | 6/1978 | Cespon | 428/307 |
| 4,097,619 | 6/1978 | Davis et al. | 282/27.5 |
| 4,112,138 | 9/1978 | Davis et al. | 282/27.5 |

FOREIGN PATENT DOCUMENTS

| | | | |
|---|---|---|---|
| 993656 | 1/1976 | Canada | 282/27.5 |
| 2556083 | 9/1976 | Fed. Rep. of Germany | 282/27.5 |

*Primary Examiner*—Bruce H. Hess

*Attorney, Agent, or Firm*—Nims, Howes, Collison & Isner

[57] ABSTRACT

An improved chemical carbonless copy paper system including an improved hot melt type of coating for CB type pressure sensitive carbonless copy paper having discrete liquid droplets of metallic salt solution electron accepting chromogenic reagent material contained therein.

24 Claims, 3 Drawing Figures

CHEMICAL CARBONLESS COPY PAPER AND TRANSFER MEDIUM THEREFOR

Figure 1:
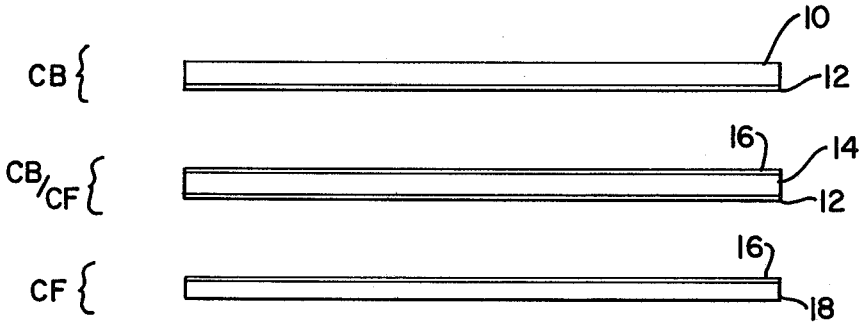

This application is a continuation in part of applications Ser. Nos. 34,030, 34,130 and 34,131 all filed Apr. 27, 1979, all abandoned.

This invention relates to pressure sensitive information transfer and duplicating systems and particularly to improved chemical type transfer and reproduction media for effecting duplicative image transfer on sheet material in response to selectively applied pressure and to processes for forming the same.

Pressure sensitive image transfer media of diverse character are widely employed in the information recording and duplicating arts. Chemical type or so-called "carbonless" pressure sensitive transfer and duplicating systems, wherein a visable image is formed by the selective chemical reaction of two essentially colorless reagents, have been long recognized as a viable expedient for the formation of duplicate copy material. Such systems normally broadly comprise a substrate supported coating that contains a first normally inactive chemical reagent material that is selectively transferable in response to applied pressure into a reaction providing and color producing relationship with a second normally inactive chemical reagent material contained within or comprising a second coating disposed on the surface of an interfacially contiguous second substrate. Conventionally illustrative of such chemical type reproduction systems are transfer and duplicating systems wherein the rear surface on one paper sheet substrate is provided with a coating and which sheet is then termed a "CB" (i.e. coated back) sheet and the front side of that same and/or a separate paper sheet substrate is provided with a coating which is then termed a "CFB" (i.e. coated front and back) or "CF" (i.e. coated front) sheet, respectively. When the coatings on a CB and a CF sheet are placed in interfacially contiguous relation and subjected to selectively applied pressure, as by the pressure of a stylus or the impact of a typewriter key on the obverse surface of the CB sheet, the operative and usually colorless chemical reagents in such coatings are brought into co-reactive relationship, as for example on the surface of the CF sheet, to produce a colored image conforming to the contour of the selectively applied pressure member.

Such chemical type pressure sensitive transfer and duplicating systems are in widespread and expanding use at the present time for the making of multiple copies of selectively recordable duplicative information on sheet material, such as paper and the like, due, at least in part, to their basic cleanliness and to the fact that the color producing reagents are inactive until placed into operative co-reactive relationship in response to selective application of pressure.

Although it was early recognized, as for example in the Gill U.S. Pat. No. 1,781,902, that many colorless chemical reagents were capable of producing a visable colored image upon interreaction therebetween, most of the systems in wide commercial usage at the present time employ a colorless organic dyestuff as a dye precursor in encapsulated liquid form distributed within the CB sheet coating and an electron accepting material in the CF sheet coating. When such CB and CF sheet coatings are placed in contiguous interfacial relation, the application of pressure effects a rupture of the liquid dyestuff confining capsular elements in the area of applied pressure to effect a release of the dye precursor material and selective transfer of at least a portion thereof into co-reacting and color producing relationship with the electron accepting material in the contiguous coating on the CF sheet with the resulting formation of a duplicative image thereon.

Some early and relatively recent patents that illustratively disclose chemical type or so-called "carbonless" transfer media employing encapsulated dye precursor materials as the chromogenic reagent in the CB coating and electron accepting materials as the chromogenic reagent in the CF coating are U.S. Pat. Nos. 2,712,507 (1955) to Green; 2,730,456 (1956) to Green et al.; and 3,455,721 (1969) to Phillips et al.

Other more recent patents that illustratively disclose the disposition of the dye precursor material in the CF coating and encapsulated electron accepting material in the CB coating include U.S. Pat. Nos. 3,787,325 (1974) to Hoover and 3,984,168 (1975) to Brockett et al.

Such "carbonless" transfer media as presently commercially employed and particularly those that conventionally employ an encapsulated type vehicle for one of the reactive constituents, most usually an organic dyestuff, are not without disadvantage. Among the recognized disadvantages of such media are the fact that they are not only relatively expensive, requiring specialized fabricating techniques, but are also unduly pressure sensitive. Such undue sensitivity often results in undesired premature transfer occasioned by inadvertent dye precursor release and transfer resulting from pressures normally attendant packaging, handling and processing operations, spot coating delineation, printing operations and the like, particularly where multicopy manifolding operations are involved. In addition, such media are inherently subject to a progressively increasing lack of copy definition as the number of desired copies increases as well as by a fading of the copied image with time.

The recently issued Shackle and Young U.S. Pat. No. 4,063,754 discloses the utilization of non-aqueous "hot melt" coating compositions for CF sheets in a carbonless transfer system incorporating acid reacting color developing reagent materials. Such patent describes, at considerable length, numerous disadvantages attendant employing solvent or water based compositions for effecting the deposition of such carbonless coatings on substrates. Among such enumerated disadvantages are the health and fire hazards attendant the release of generally volatile solvent vapors and the expenditure of significant amounts of energy for the evaporation of the water from aqueous solvent systems. In addition, the practical necessities of solvent recovery and the drying of aqueous coating compositions requires relatively complex and expensive apparatus as well as the attendant problem of solvent safety hazards and disposal of polluted water attendant preparation and clean-up of such aqueous coating compositions.

A further recently issued patent to Shackle and Young's assignee, i.e. U.S. Pat. No. 4,112,138, Davis and Shackle for Manifold Carbonless Form and Process for the Production Thereof discloses the utilization of non-aqueous, solvent free "hot melt" coating compositions for CB sheets. The specification of this patent similarly describes, at considerable length, the numerous disadvantages attendant employing solvent or water based compositions for effecting the deposition of carbonless coatings on substrates.

The Shackle and Young patent and the Davis and Shackle patent stress the "non-aqueous" and "solvent free" character of the assertedly novel hot melt coating compositions, apparently based upon the asserted disadvantages flowing from the presence of water both in the fabrication process and in the finished product. The Davis and Shackle patent discloses the preferred use of microcapsular chromogenic reagent materials in the CB coating although the process claims are not expressly limited thereto. Although the Shackle and Young patent is expressly directed to a hot melt CF coating, the vehicular form of the acidic electron accepting type of color developer, i.e. whether microencapsulated, capsulated, dispersed or other form, is not particularly specified. It is relatively clear, however, that the described CF product is intended for use with CB sheets incorporating an organic dyestuff dye precursor in encapsulated form and, as such, represents an asserted improvement for the capsular type systems presently in widespread commercial use.

The present day widespread commercial employment of CB sheets incorporating encapsulated organic dyestuff dye precursor materials, is, as mentioned above, not without disadvantage, such as undue expense, premature activation, limited reproduction fidelity in multiple copies and detrimental fading of the reproduced images. Such disadvantages have been largely tolerated because of the absence of a viable commercially acceptable alternative. As pointed out above, it was early recognized that many chemical reagents were capable of producing visable duplicative images in chemical transfer paper usage. The aforementioned Gill U.S. Patent, for example, employed a member of the gallo-tannic acid series as the chromogenic reagent in the CB sheet coating in association with a ferrous or ferric salt as the chromogenic reagent in the CF sheet coating. In contradistinction to the later Shackle and Young and Davis and Shackle's disclosures, this system requires the presence of solvent at or in the CF sheet coating for the color producing reaction to go forward and hence Gill teaches the inclusion of "a small percentage of glycerine or other non-drying substance, or a hygroscopic ingredient" in the CF sheet coating. The need for the presence of moisture and the deleterious effects of such moisture on the paper substrate was early recognized in the Gookin et al. U.S. Pat. No. 1,950,982, who provided a water impervious film intermediate the substrate and the CB and CF sheet coatings and included in the latter both magnesium chloride as chromogenic reagent material and glue or gelatine as moisture retaining material. A somewhat different approach was followed in Groak U.S. Pat. No. 2,168,098, who disclosed a CB sheet coating composed of a hard waxy substance having dispersed therein an admixture of starch, a hydroscopic material, such as glycerine, and a color producing reactive substance. In neither of these approaches, however, was water included as a necessary ingredient in the coating composition and thus basically conformed in such disclosure and teaching to the later issued Shackle patents.

Some of the aspects of the approach that was early suggested by the Gill, Gookin and Groak patents have recently reappeared in Austrian Patent No. 331,825 which issued Mar. 25, 1976 (and apparent counterpart Canadian Patent No. 993,656 and West German publication No. 2,342,596 of Apr. 11, 1974). In these disclosures, an organic dyestuff dye precursor is dispersed in a binder on the CF sheet and used in conjunction with an essentially fully transferable CB sheet coating which incorporates clay materials as the electron accepting chromogenic reagent material, either alone or in association with phenolic material and inorganic salts of multivalent metals. Solvent, water based and hot melt systems are specifically disclosed for the CB sheet coatings. Significantly, however, the hot melt CB sheet coatings are all water free, again in conformity with the Shackle teachings.

A later issued West German patent application No. 25 56 083.2 of Sept. 2, 1976 (based on Austrian application No. A1405/75 of Feb. 25, 1974 and its apparent counterpart abandoned U.S. application Ser. No. 655,019 of Feb. 4, 1976 as referenced in U.S. Pat. No. 4,096,314) discloses the utilization of metal chlorides, preferably in combination with urea or urea derivatives, as CF sheet coatings in both solvent and aqueous systems. In association therewith, there is disclosed the utilization of organic dyestuff dye precursors dispersed in a hot melt coating medium as the CB coating. The preferred CF sheet coatings are identified as those, for a water based coating, that contain zinc chloride and urea and further include a metal stearate.

This invention may be briefly described, in its broad aspects, as an improved chemical type transfer and duplicating system comprising a hot melt type of CB sheet coating containing and retaining discrete and selectively constituted liquid electron accepting chromogenic reagent material and to methods for forming the same. In its narrower aspects, the subject invention includes a novel hot melt CB coating constituted of an intermixture of natural and synthetic waxes containing and retaining discrete microscopic droplets of a selectively constituted solution of a metallic chloride, preferably zinc chloride in water suitably buffered to minimize, if not effectively neutralize, the available acidic chloride content thereof uniformly distributed therewithin as a color producing reagent. In a still further aspect, the invention includes a compatible improved CF sheet coating having a plurality of water insoluble dye precursors in solid form selectively dispersed and distributed throughout an alkaline biased carrier film.

Among the manifold advantages attendant the practice of the subject invention is the provision of improved low cost carbonless transfer media that serve to provide markedly increased numbers of duplicative copies with sharper, more intense and highly smear resistant transferred images. Additional advantages include compatability with "one time" carbon papers and standard printing inks; a permitted reduction in basis weights and the provision of an odorless CB sheet coating that can be reused one or more times, thus permitting retyping on the obverse surface thereof. Other advantages include the provision of a CB sheet coating that can be readily striped and spot coated and which is recyclable. Still other advantages include the provision of a CB sheet coating that can be fabricated with minimal energy requirements on conventional coating equipment requiring minimal capital investment. Further advantages include the provision of transferred images that are effectively stable in character and a system which is operable at temperatures as low as −30° F. Still further advantages include the provision of coatings of extended shelf life that are markedly resistant to undesired premature activation under conditions of high temperature and/or high humidity; that are characterized by reduced potential to irritate sensitive skins and to corrode iron rollers and other components of coating, printing and collating apparatus; coatings that are essentially uncritical as to substrate character and which are highly resistant to undesired transfer on printing presses, collators and other equipment normally incident to manifolding, printing and packaging operations.

A principal object of this invention is the provision of improved chemical type pressure sensitive transfer and reproduction media, to processes for fabricating the same and to improved systems employing such media.

A further principal object of this invention is the provision of an improved hot melt chromogenic reagent containing coating composition for CB transfer sheets.

Another object of this invention is the provision of an improved composite wax base hot melt type of CB sheet coating containing discrete droplets of a selectively constituted water solution of a metallic chloride suitably buffered to minimize, if not effectively neutralize, the available acidic chloride content thereof uniformly distributed therewithin as a color producing reagent.

A further object of this invention is the provision of an improved water base metallic chloride solution for use as electron accepting chromogenic reagent material in carbonless transfer systems that is effectively non-corrosive and non-irritating and which is highly resistive, when dispersed in a hot melt carrier vehicle, to undesired premature image actuation under conditions of high temperature and/or high humidity.

A still further object of this invention is the provision of an improved water base metallic chloride solution for use as electron accepting chromogenic reagent material in carbonless transfer systems.

Other objects and advantages of the subject invention will become apparent from the following portions of this specification which describe, in accord with the mandate of the patent statutes, the principles of the invention and best mode presently contemplated by the inventors for carrying out said inventions.

Figure 2A:
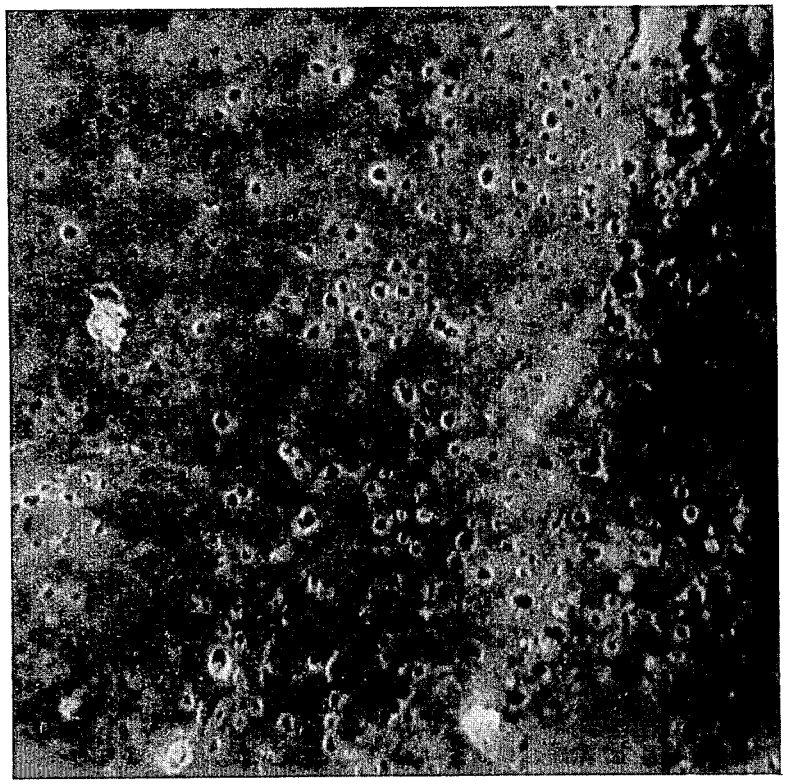
Figure 2B:
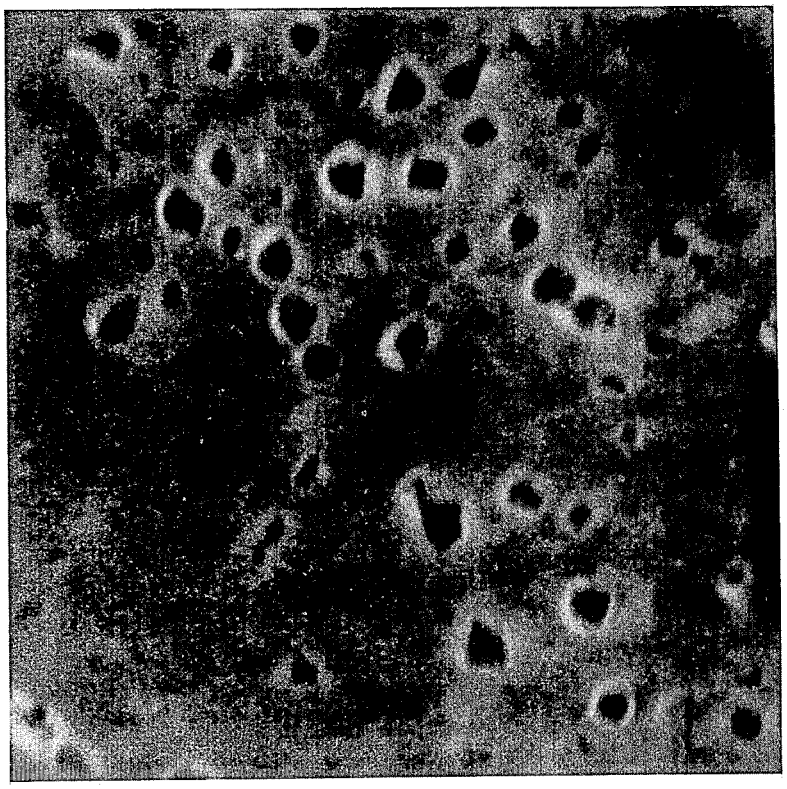

FIG. 1 is a schematic representation of chemical type pressure sensitive transfer and reproduction media incorporating the principles of this invention; and FIGS. 2*a* and 2*b* are photomicrographs (4200X and 14000X) of an improved hot melt CB coating formed and constituted in accordance with the principles of this invention.

Referring to the drawings and initially to FIG. 1, there is provided an illustrative set of chemical type or carbonless transfer and reproduction media fabricated in accord with the principles of the invention. As there shown, such set includes a CB sheet comprising a first planar substrate 10, suitably a paper sheet or web, having a thin solidified hot melt CB coating 12, constituted as hereinafter described, disposed on the undersurface thereof. Adapted to be positioned in interfacially contiguous relation with the CB coating 12 on the underside of substrate 10 is a CF sheet coating 16 disposed on the upper surface of a second paper sheet substrate 14. Such substrate 14 may have its undersurface coated with a CB coating 12 and thus constitute a CFB sheet, or may have an uncoated undersurface and thus constitute a CF sheet. Alternatively, and illustratively adapted to be disposed in interfacially contiguous relation with either a CB coating 12 on the underside of the "CFB" sheet 14 or with a CB coating 12 on the underside of the "CB" sheet 10, is a separately illustrated "CF" sheet having a CF coating 16 disposed on the upper surface of a third substrate 18. As will be apparent to those skilled in the art, any number of intermediate CFB sheets or webs 14 may be interposed in stacked relation to form a multilamina transfer and reproduction system. Likewise, such multilamina set may include one time carbon transfer sheets interposed with uncoated or CB coated sheets or webs in a manifold arrangement in accord with the dictates of the user thereof.

The novel and improved hot melt CB sheet coating broadly comprises the resulting set or solidified film from an applied and subsequently cooled emulsified liquid intermixture of a melted low oil content wax carrier vehicle, preferably of composite character, a melted synthetic flow wax and dispersant and a chromgenic reagent solution of a metallic chloride, preferably zinc chloride, dissolved in water and suitably buffered to minimize, if not effectively neutralize the available acidic chloride content thereof; said emulsified intermixture also desirably having uniformly dispersed therein small but critically limited amounts of a resinous film forming agent to promote film hardness and toughness, an isolating agent to minimize, if not effectively preclude, undesired transfer of the coating or portions thereof in response to unintentional pressure application and an opacifier-filler to reduce the gloss of the finished copy and preserve the appearance of the substrate.

In its narrower aspects, the subject invention includes a hot melt CB sheet coating composition formed of about 35 to 75 percent of a meltable low oil content synthetic or naturally derived hard wax vehicle; at least 1 to about 15 percent of a chemically modified wax-like material having properties of a flow agent, dispersant and emulsifier; and at least 10 to about 35 percent of a chromogenic reagent component in the form of a Lewis acid, desirably an electron accepting hydroscopic, if not actually deliquescent, metallic salt together with an amount of water necessary to desirably form a relatively concentrated solution thereof.

Optionally but desirably included in such CB sheet coating composition for provision of an enhanced commercially attractive product are one or more of the following additional constituents. One such optional constituent comprises a film forming agent to encourage the formation of a harder and tougher surface film after setting and to thus minimize premature actuation of the color producing reaction. This film forming agent must be non-reactive with the chromogenic reagent and may vary in amount from a minimum of about 2% up to an amount that deleteriously effects the flow characteristics of the mix. Another such optional but yet desirable constituent comprises an isolating agent that is essentially incompatible with the wax vehicle when solidified and which serves to provide desirable surface characteristics to the resultant film, such as to minimize, if not effectively preclude, undesired transfer of the coating or portions thereof in response to unintentional pressure application. The isolating agent may vary in amount from a desirable minimum of about 2% up to a maximum of about 20%. A still further optional but desirable constituent in an opacifier-filler to enhance the appearance of the coated surface of the CB sheet, such as by reducing the gloss thereof. As is well known in this art, such opacifier-filler may vary in amount required to provide a desired appearance, typically about 5%, and may include titanium dioxide, various non-acidic high brightness clays, lithopone or other recognized materials.

The meltable wax vehicle may suitably comprise any of the low oil content paraffin waxes, microcrystalline waxes, carnauba, Montan or other conventionally employed low oil content vegetable, synthetic or mineral derived hot melt wax type carrier vehicles. The presently preferred meltable wax vehicle, a composite made up of about 3 to 4 parts of a low oil content paraffin wax, intermixed with about 1 part or less of carnauba wax. A presently preferred paraffin wax is a low oil content, high melting point, fully refined paraffin wax, suitably Pacemaker 53 as manufactured and sold by Cities Service Oil Co. of Tulsa, Oklahoma. Such wax has the following properties:

| | |
|---|---|
| Melting point, ASTM, °F. | 143-150 |
| Melting point, AMP | 146-153 |
| Oil Content, Wt. % max | 0.25 |
| Odorless | |
| Viscosity, cs at 210° F. | 5.5 |
| Needle penetration at 77° F. | 13 |
| Flash point °F. | 485 |

Other suitable low oil content hot melt wax carrier vehicles include alpha olefinic waxes, suitably #6817 Synthetic Wax as available from Moore & Munger Inc. of Fairfield, Connecticut; microcrystalline wax, suitably 195 Be Square White, available from Petrolite Corporations Bareco Division; of carnauba wax, suitably Brazilian Refined available from Baldini & Company of Milburn, New Jersey.

Moore & Munger's #6817 Synthetic Wax has the following properties:

| | |
|---|---|
| Congealing Point, °F., ASTM D 938 | 162 |
| Needle penetration, mm/10, ASTM D 1321 77° F. | 14 |
| Viscosity, Saybolt (a) 210° F. (SUS), ASTM D 2161 | 52 |
| Viscosity, Kinematic (a) 210° F. (Cs.). ASTM D 445 | 8 |
| Color, Saybolt, ASTM D 156 | +4 |
| Flash Point, °F. (COC) | 510 |

Bareco's 195 Be Square White microcrystalline wax has the following properties:

| | |
|---|---|
| Melting Point, °F. ASTM D 127 | 193/198 |
| Penetration (a) 77° F. ASTM | 6/7 |
| Color ASTM D 1500 | 0.5/0.5+ |

A preferred carnauba wax in Baldini's Brazilian Refined Carnauba wax that is possessed of the following properties:

| | |
|---|---|
| Melting Point, min., °F. | 180.5 |
| Acid Number | |
| minimum | 4.0 |
| maximum | 10.0 |
| Saponification Number | |
| minimum | 78.0 |
| maximum | 88.0 |

The meltable chemically modified wax-like material having the desired properties of a flow agent, dispersant and emulsifier most suitably comprises a material of the type disclosed in U.S. Pat. No. 3,941,608. Other suitably chemically modified wax materials having the somewhat similar properties include modified synthetic waxes as disclosed in U.S. Pat. Nos. 2,890,124, 2,890,125 and 3,163,548. A preferred commercially available wax-like material formulated in accord with U.S. Pat. No. 3,941,608 is #7315 wax as sold by Moore & Munger, Inc., of Fairfield, Connecticut. Such #7315 wax has the following general properties:

| | |
|---|---|
| Penetration Hardness (FLP)I-22 | 5 Typical |
| Melting Point (Fisher Johns) | 144°Typical |
| Acid Number (ASTM D 974) | 2 Typical |

Another suitable wax-like material having somewhat similar properties as the foregoing suitably comprises an amide of a fatty acid, such as Armid HT as available from Armour Industrial Chemical Company. Such Armid HT is possessed of the following properties:

| | |
|---|---|
| Amide % (min.) | 90 |
| Iodine value | |
| minimum | — |
| maximum | 5 |
| Free fatty acid % | |
| minimum | — |
| maximum | 5 |
| Melting Point, °C. | |
| minimum | 98 |
| maximum | 103 |

The resinous film forming agent serves to enhance the formation of a relatively hard and tough coating to minimize undesired transfer of reagent material across the CB/CF interface in the absence of intentional positive pressure application. A suitable film forming agent, which must be non-reactive with the chromogenic reagent component, desirably comprises a relatively low melting point ethylene-vinyl acetate copolymer, such as AC-400, as manufactured and sold by Allied Chemical Corporation. Such resinous film forming agent has the following properties:

| | |
|---|---|
| Softening Point (ASTM E-28) | 204° F. |
| Hardness (ASTM D-5) | 9.5 |
| Density 8/cc (ASTM D-1505) | 0.92 |
| Viscosity (284° F. - Brookfield) | 550 |

Another suitable film forming agent comprises oxidized polyethylene, suitably AC-629 as manufactured and sold by Allied Chemical Company. Such film forming agent has the following properties:

| | |
|---|---|
| Softening Point | 214° F. |
| Hardness | 5.5 |
| Density g/cc | 0.93 |
| Average Viscosity CPS 284° F. | 160 |
| Acid Number | 15 |

The isolating agent cooperatively functions as blooming agent to provide a lubricating and barrier surface to the solidified coating. Such isolating agent, which should be essentially incompatible with the wax carrier vehicle when solidified, so as to be selectively effective at the exposed surface, suitably comprises a small amount of stearic acid, desirably HYSTRENE 9718 as manufactured and solid by the Humko Chemical Company. Zinc stearate may also be employed.

The opacifier-filler, which cosmetically serves both to reduce the gloss of the finished coating and to preserve the appearance of the substrate, suitably comprises finely divided titanium dioxide such as UNITANE 0-110 as manufactured and sold by American Cyanamid Company. This material has a specific gravity of about 3.9 and is so finely divided as to leave only about a 0.10% residue on a 325 mesh screen.

The chromogenic reagent component preferably comprises a concentrated water base solution of zinc chloride as the electron accepting metallic chloride, suitably buffered to minimize, if not effectively neutralize, the available acidic chloride content thereof. Such solution is preferably made up of about 2 to 4 parts of zinc chloride with about 1 part of water and which approaches a saturated solution.

Other chromogenic reagent components comprise concentrated water base solutions of metallic halogen salts such as stannous chloride, ferric chloride, lithium bromide and nickel chloride.

While unbuffered solutions of zinc chloride as the chromogenic reagent have provided highly effective image formation in transfer coatings as formulated in accord with the foregoing disclosed formulations, such have been subject, under extreme climatic conditions of high temperatures and/or high humidity, to the apparent generation and emanation of hydrogen chloride. Although the quantities of hydrogen chloride so generated, appear to be minimal, even under such extreme climatic conditions, the apparent emanation thereof from the applied coating has resulted in varying degrees of premature actuation of the dye precursors over the entire surface of an interfacially contiguous CF coating and, depending on the ambient climatic conditions, in varying degrees of actuation of such CF sheet. Such premature actuation is, of course, highly undesirable, as is the generation of hydrogen chloride with its potential to irritate sensitive skins and to corrode iron rollers and other components of the processing equipment under any set of climatic conditions.

In order to neutralize, if not actually prevent, the generation and emanation of such hydrogen chloride, a small amount of a neutralizing ammonium salt, suitably ammonium carbonate or ammonium bicarbonate, is dissolved in the zinc chloride solution. For a concentrated solution of about 2 parts of zinc chloride to 1 part of water, about 0.1 part of such neutralizing ammonium salt is generally satisfactory. Experience to date has generally indicated that the addition of about 2 to 4% of ammonium carbonate to zinc chloride solutions of the type herein disclosed results in effective avoidance of the above problems in an improved product.

While the mechanics of the reaction process are not fully understood it is surmised that the ammonium salt operates to neutralize or otherwise reduce the available active or acid chloride ion content and to thus preclude its association with available hydrogen ions. Also the possible availability of ammonia in both the liquid and gaseous phase may also contribute to the neutralization of hydrogen chloride in both such phases.

Apart from the foregoing, the additions of such neutralizing ammonium salt has provided some totally unexpected and, as yet, unexplainable advantages and results. Such unexpected results are a bleaching and a marked increase in the hardness of the solidified CB hot melt coating. Such increase in hardness not only functions to minimize pick off on processing components, reduces the tendency to smear and provides sharper copy, but also permits of significant reduction in the quantity of carnauba wax that is otherwise desirably included therein. Carnauba wax is not only one of the more cost significant components of the coating but is also only obtainable from a foreign source of supply who controls the ever increasing price thereof.

The unexpected bleaching action also enhances the appearance of the product through an enhancement of the "whiteness" of the coating.

A presently preferred hot melt CB sheet coating broadly comprises the resulting set or solidified film from an applied and subsequently cooled emulsified liquid intermixture of about 50–60% of a melted low oil content composite wax carrier vehicle, made up of about 3 to 4 parts of a low oil content paraffin wax intermixed with about 1 part of carnauba wax; about 2 to 5% of a chemically modified synthetic flow wax and dispersant and about 25–35% of a chromogenic reagent solution of at least 2 parts of zinc chloride dissolved in about 1 part of water buffered by a small amount of ammonium carbonate as outlined above; said emulsified intermixture also desirably having uniformly dispersed therein about 3 to 10% of a resinous film forming agent to promote film hardness and toughness, about 3–10% of an isolating agent to minimize, if not effectively preclude, undesired transfer of the coating or portions thereof in response to unintentional pressure application and about 5% of an opacifier-filler to reduce the glass of the finished copy and preserve the appearance of the substrate.

In the production of the above described preferred CB sheet coating composition in accord with the principles of this invention, the requisite amounts of the electron accepting metallic chloride, preferably $ZnCl_2$, and water are intermixed in a reaction vessel, suitably a steam jacketed kettle having a 210° F. temperature setting, to form a hot concentrated solution thereof. To such solution is then added the neutralizing ammonium salt, preferably ammonium carbonate. To such elevated temperature and now neutralized chromogenic reagent solution, the requisite amounts of melted low oil content paraffin wax and carnauba wax components of the composite wax carrier vehicle are added and thoroughly intermixed as by use of a high speed dispersing blade for about 10 minutes or longer. To the intermixture as so constituted, the flow wax and dispersant constituent and the polyethylene filming agent and stearic acid isolating agent constituents are added in solid form with continual mixing until such constituents are completely melted and dissolved in the composite wax carrier vehicle. When so melted and dissolved the opacifier-filler, preferably titanium dioxide is added and the entire mass thoroughly mixed at high speed for 30 to 40 minutes to form a selectively constituted liquid hot melt emulsion.

The resulting liquid hot melt emulsion is readily and selectively applied in the form of a thin film, as for example at a coating weight of as low as 2 grams/square meter, by conventional means to the surface of a substrate, such as a sheet or web of paper or resinous film. The conventional coating means may comprise a print type coater, a roll coater or the like. The so coated substrate is then passed over a chill roll or the like to rapidly solidify or set the applied emulsified coating composition.

In contradistinction to the systems of the prior art which were operatively dependent upon an external water source (often humid air) to provide the necessary ionized zinc chloride to react with the dye precursor, the system of the present invention contains and retains water as an operative element in discrete droplet liquid form within the solidified CB film and thus effects the selective transfer of ionized zinc chloride as the operative entity.

Photomicrographs of coatings formulated in accord with the principles of this invention are shown in FIGS. 2*a* and 2*b* at magnifications of 4200X and 14000X respectively. These photomicrographs clearly depict the presence of discrete, microscopically sized zinc chloride ammonium salt solution globules distributed throughout the coating. Most of such globules are less than 1 micron in diameter with the great majority thereof falling between 0.25 and 0.75 microns. Such photomicrographs further show that such zinc chloride solution globules peripherally incorporate an interface layer or the like that differs, at least in some physical respects from both the zinc chloride solution globules and from the surrounding solidified wax material as evidenced by the clearly different refractive indices involved.

To the above ends, the foregoing described method of formulation provides a selectively constituted emulsion in which zinc chloride solution entities are thoroughly dispersed within the film. The basic hygroscopic, if not actual deliquescent, properties of zinc chloride and the nature of the resultant film serve to minimize, if not effectively prevent, water loss in storage with enhanced operating life for the product.

Another factor which contributes to the retention of the dispersed zinc chloride solution in discrete liquid globular form within the CB film is the enhanced emulsification obtained through the use of an essentially alkaline and amino containing dispersant—flow wax constituent in association with the relatively high acid number wax and film forming components.

By way of further examples the following formulations have provided CB sheet coating having in varying degree, the manifold advantages earlier set forth.

EXAMPLE I

| | % |
|---|---|
| Paraffin Wax | 45.0 |
| 7315 Wax | 2.0 |
| AC-400 Polyethylene | 5.0 |
| Stearic Acid | 3.0 |
| Titanium Dioxide | 5.0 |
| Zinc Chloride | 30.0 |
| Water | 10.0 |

EXAMPLE II

| | |
|---|---|
| Paraffin Wax | 41.0 |
| 7315 Wax | 2.0 |
| AC-629 Polyethylene | 7.0 |
| Titanium Dioxide | 5.0 |
| Zinc Stearate | 10.0 |
| Zinc Chloride | 30.0 |
| Water | 5.0 |

EXAMPLE III

| | |
|---|---|
| Paraffin Wax | 35.0 |
| AC-400 Polyethylene | 10.0 |
| Zinc Chloride | 20.0 |
| Water | 10.0 |

-continued

| | |
|---|---|
| 7315 Wax | 10.0 |
| Stearic Acid | 10.0 |
| Titanium Dioxide | 5.0 |

EXAMPLE IV

| | % |
|---|---|
| Paraffin Wax | 55.0 |
| Carnauba Wax | 20.0 |
| Zinc Chloride | 15.0 |
| Water | 5.0 |
| 7315 Wax | 2.0 |
| Stearic Acid | 3.0 |

EXAMPLE V

| | |
|---|---|
| Paraffin Wax | 10.0 |
| Microcrystalline Wax | 30.0 |
| Stannous Chloride | 30.0 |
| Water | 10.0 |
| 7315 Wax | 3.0 |
| Stearic Acid | 7.0 |
| Titanium Dioxide | 10.0 |

EXAMPLE VI

| | |
|---|---|
| Carnauba Wax | 10.0 |
| Alpha Olefin Wax | 40.0 |
| AC-629 Polyethylene | 7.0 |
| Ferric Chloride | 20.0 |
| Water | 10.0 |
| 7315 Wax | 3.0 |
| Stearic Acid | 5.0 |
| Titanium Dioxide | 5.0 |

By way of further preferential example, the above formulations, when buffered to minimize, if not effectively neutralize, the available acidic chloride content thereof, are modified as follows:

EXAMPLE IA

| | % |
|---|---|
| Paraffin Wax | 42.0 |
| 7315 Wax | 2.0 |
| AC-400 Polyethylene | 5.0 |
| Stearic Acid | 3.0 |
| Titanium Dioxide | 5.0 |
| Zinc Chloride | 30.0 |
| Ammonium Carbonate | 3.0 |
| Water | 10.0 |

EXAMPLE IIA

| | |
|---|---|
| Paraffin Wax | 38.0 |
| 7315 Wax | 2.0 |
| AC-629 Polyethylene | 7.0 |
| Titanium Dioxide | 5.0 |
| Zinc Stearate | 10.0 |
| Zinc Chloride | 30.0 |
| Ammonium Bicarbonate | 3.0 |
| Water | 5.0 |

EXAMPLE IIIA

| | % |
|---|---|
| Paraffin Wax | 33.0 |
| AC-400 Polyethylene | 10.0 |
| Zinc Chloride | 20.0 |
| Ammonium Carbonate | 2.0 |
| Water | 10.0 |
| 7315 Wax | 10.0 |
| Stearic Acid | 10.0 |
| Titanium Dioxide | 5.0 |

EXAMPLE IVA

| | % |
|---|---|
| Paraffin Wax | 51.0 |
| Carnauba Wax | 20.0 |
| Zinc Chloride | 15.0 |
| Ammonium Carbonate | 4.0 |
| Water | 5.0 |
| 7315 Wax | 2.0 |
| Stearic Acid | 3.0 |

EXAMPLE VA

| | |
|---|---|
| Paraffin Wax | 9.0 |
| Microcrystalline Wax | 28.0 |
| Stannous Chloride | 30.0 |
| Ammonium Bicarbonate | 3.0 |
| Water | 10.0 |
| 7315 Wax | 3.0 |
| Stearic Acid | 7.0 |
| Titanium Dioxide | 10.0 |

EXAMPLE VIA

| | |
|---|---|
| Carnauba Wax | 8.0 |
| Alpha Olefin Wax | 38.0 |
| AC-629 Polyethylene | 7.0 |
| Ferric Chloride | 20.0 |
| Ammonium Carbonate | 4.0 |
| Water | 10.0 |
| 7315 Wax | 3.0 |
| Stearic Acid | 5.0 |
| Titanium Dioxide | 5.0 |

The following formulations have provided highly preferred CB sheet coatings:

EXAMPLE VII

| | % |
|---|---|
| Paraffin Wax | 39.0 |
| Carnauba Wax | 14.0 |
| Zinc Chloride | 20.0 |
| Water | 10.0 |
| 7315 Wax | 2.0 |
| AC-400 Polyethylene | 5.0 |
| Stearic Acid | 5.0 |
| Titanium Dioxide | 5.0 |

EXAMPLE VIIA

| | |
|---|---|
| Paraffin Wax | 36.0 |
| Carnauba Wax | 14.0 |
| Zinc Chloride | 20.0 |
| Water | 10.0 |
| Ammonium Carbonate | 3.0 |
| 7315 Wax | 2.0 |
| AC-400 Polyethylene | 5.0 |
| Stearic Acid | 5.0 |
| Titanium Dioxide | 5.0 |

The foregoing hot melt CB coatings may be employed with effectively all CF coatings that incorporate an organic dyestuff or other chromogenic reagent color precursor that will react with the ionized electron accepting metallic salt when the latter is introduced into operative relation therewith. By way of further example, satisfactory results have been obtained when such CB sheets are used with Cf coating compositions constituted as hereinafter disclosed.

In its broad aspects, suitable CF coatings comprise the solid residue of an applied alkaline homgeneous mixture of an evaporable liquid carrier, a chemically neutral or alkaline resinous binder, an organic color precursor and an opacifier-filler. Such solidified CF coatings are further characterized by the presence of the organic color precursor in solid form and which is insoluble in the liquid electron accepting chromogenic reagent solution contained in the CB coating. Optionally but desirably included therein is a dispersant to assure the uniform dispersion of the color precursor throughout the mix and a thickener to provide the requisite viscosity properties to facilitate the coating of the mix in accord with the particular requirements of the coating equipment employed.

The evaporable liquid vehicle may comprise water or numerous organic solvents or mixtures thereof such as ethyl alcohol, methyl ethyl ketone, toluene and the like. Likewise, the opacifier-filler may constitute titanium dioxide, zinc oxide, lithopone, calcium carbonate or neutral clays or intermixtures thereof.

A preferred CF coating employs water as the evaporable liquid vehicle and generally comprises the solid residue of an applied water based intermixture, such intermixture comprising about 3 to 20 parts of a chemically neutral or alkaline resinous binder, suitably polyvinyl acetate; about 10 to 40 parts of an opacifier-filler; about 0.5 to 5 parts of a water insoluble acid reactable organic color precursor mixture and about 30 to 70 parts of water.

Although many acid reactable organic color precursors can be employed, the presently preferred color precursor comprises a mixture of water insoluble, alkaline stable and acid sensitive organic dyestuffs to produce a dark light stable and lasting image. Desirably included in such preferred mixture is crystal violet lactone, suitably about 0.7 parts thereof, which provides for rapid reaction and image production, together with about an equal amount of a blue/black dye precursor, and lesser amounts of a red color dye precursor, suitably about 0.2 parts thereof and a blue dye precursor, suitably about 0.4 parts thereof to provide for desired image color and a high degree of light stability and increased useful life.

A suitable crystal violet lactone comprises Brilliant Violet Leuco (CVL) as manufactured by Hilton Davis Chemical Co. This dye precursor is believed to be 6-dimethylamino-3,3-bis(p-dimethylaminophenyl)phthalide having a molecular formula of $C_{26}H_{29}N_3O_2$ and a molecular weight of about 415.5. The blue/black dye precursor suitably comprises Copykem VI as manufactured by Hilton Davis Chemical Co. and the blue dye precursor suitably comprises Reacto Blue B as manufactured by BASF.

The nature of the binder is not attended with any particular degree of criticality as long as it functions as a binding agent for the opacifier-filler and the color precursor, with both of the latter being in solid form. A preferred resinous binder material comprises polyvinyl acetate emulsion, suitably Airflex 456 as manufactured by Air Products & Chemicals Company. Another suitable binder material comprises an acrylic emulsion, for example Rhoplex P-376 as manufactured by Rohm & Haas Corp.

The opacifier-filler, which serves both to enhance the appearance of the coating and to cooperate in the uniform distribution and spaced separation of the solid color precursor in the CF coating must also be of neutral or alkaline character. Such filler may suitably comprise calcium carbonate such as Albaglos as manufactured by Chas. Pfizer & Co. This material has a pH of 9.4, a specific gravity of 2.7 and an average particle size of about 0.75 microns. Another suitable opacifier-filler is UNITANE 0-110 titanium dioxide as manufactured by the American Cyanamid Company. This material has a minimum $TiO_2$ content of 99%, a pH of about 7.7 and a specific gravity of about 3.9.

A presently preferred dispersant comprises sodium salt of polymeric carboxylic acid, such as Tamol 850 as manufactured by Rohm & Haas Company of Philadelphia, Pa. This material has a pH of about 9.8 and a specific gravity at 25° of 1.19.

In the production of the above described receptor coating for the CF sheets, a water base intermixture of preemulsified polyvinyl acetate, the dispersant and the opacifier-filler, suitably $TiO_2$, is formed with continuous agitation to effect a thorough dispersion of the filler and binder constituents therein. Into this mixture is introduced the organic dyestuff dye precursor chromogenic reagent component, again with continuous agitation to effect a complete and uniform dispersion of the dye precursor particles within the liquid intermixture.

The resultant emulsion-dispersion is readily and selectively applied by conventional coating equipment in the form of a thin film to the surface of a substrate, such as a sheet or web of paper or of resinous film. When so applied, the water is then evaporated from the mixture and residue constitutes the improved CF coating.

By way of specific example, the following formulations have provided a CF sheet coating possessing the marked advantages hereinbefore set forth:

EXAMPLE VIII

| | |
|---|---|
| Water | 46.3 |
| Dispersant (Tamol 850) | 0.2 |
| Titanium dioxide | 5.5 |
| Calcium carbonate | 26.8 |
| Polyvinylacetate emulsion | 19.2 (52% solids) |
| Crystal violet lactone | 0.7 |
| Red dye precursor | 0.2 |
| Blue/black dye precursor | 0.7 |
| Blue dye precursor | 0.4 |

EXAMPLE IX

| | |
|---|---|
| Water | 69.0 |
| Dispersant (Tamol 850) | 0.3 |
| Calcium carbonate | 17.0 |
| Acrylic emulsion | 13.0 (50% solids) |
| Crystal violet lactone | 0.5 |
| Red dye precursor | 0.2 |

Such CF sheet coating may also comprise the solid residue of an applied intermix of an evaporable solvent carrier, suitably 35 to 75 parts of 95% ethyl alcohol and at least about 3 parts of methyl ethyl ketone, having dissolved therein at least about 5 parts of a binder, suitably polyvinyl acetate. Added thereto is about 0.2 parts of a dispersant and about 0.1% of dry potassium hydroxide to provide an alkaline cast to the mix and to minimize inadvertent color reactions on the CF coated sheet. Also included in the mix is about 5 parts of an opacifier-filler, suitably finely divided titanium dioxide and about 15 parts of calcium carbonate. Starch, such as corn starch, may also be included, in lieu of or in addition to, portions of opacifier-filler to serve as a spacing agent. While any suitable chromogenic reagent material may be employed, satisfactory results have been obtained through the incorporation therein of small but critical quantities of a primary organic dyestuff dye precursor, such as about 0.5 to 2 parts of crystal violet lactone. Preferably, additional organic dyestuff dye precursor materials serving as color modifiers and intensifiers may also be included in the chromogenic reagent material, suitably red and blue/black color organic dyestuff dye precursors.

A preferred binder material which is readily soluble in the above described composite evaporable solvent carrier comprises polyvinylacetate, suitably Vinac B-15, as manufactured by Air Products & Chemicals Company.

A presently preferred dispersant comprises sodium salt of polymeric carboxylic acid such as Tamol 731 as manufactured by Rohm & Haas Company of Philadelphia, Pa.

The chromogenic material may be of conventional character and a presently preferred material comprises "Brilliant Violet Leuco" (CVL) as manufactured by the Hilton Davis Chemical Company of Cincinnati, Ohio.

In the production of the above described receptor coating for CF sheets, a liquid mixture is first formed by (a) intermixing the ethyl alcohol and methylethylketone solvents; then (b) the polyvinyl acetate binder material, the dispersant, the potassium hydroxide (to cast the pH of the solution to the alkaline side) are added with continuous agitation until completely dissolved after which (c) the organic dyestuff dye precursor materials are added with continued stirring until dissolved. To the above liquid mixture is then added the requisite amounts of calcium carbonate and the titanium dioxide opacifier-filler. Such addition should be accompanied by continuous stirring of such constituents in the liquid vehicle to obtain a uniform dispersion thereof.

The above described organic dyestuff color precursor materials are stable in alkaline media and, within the above formulation ranges, such coating composition can be used to coat most all paper substrates without any effect on the reaction time or the density of the image produced when using the CB sheet coatings described above.

By way of specific example, the following formulation has provided a satisfactory CF sheet coating.

EXAMPLE X

| Raw Materials | % |
|---|---|
| Ethyl Alcohol (95%) | 52.3 |
| Polyvinyl Acetate Beads | 15.0 |
| Potassium Hydroxide Flakes | 0.1 |
| Tamol 731S.D. Dispersant | 0.2 |
| Titanium Dioxide | 5.0 |
| Calcium Carbonate | 15.0 |
| Methyl Ethyl Ketone | 10.0 |
| Crystal Violet Lactone (CVL) | 1.2 |
| Red Color Precursor | 0.6 |
| Blue/Black Precursor | 0.6 |

A further example of a satisfactory CF coating is

EXAMPLE XI

| | Wet Bases % |
|---|---|
| Ethyl Alcohol (95%) | 40.0 |
| Polyvinylacetate | 10.0 |
| Tamol 731 Dispersant | 0.2 |
| Potassium Hydroxide | .5 |
| Titanium Dioxide | 17.0 |
| Calcium Carbonate | 7.0 |
| Corn Starch | 10.0 |
| Methyl Ethyl Ketone | 15.0 |
| Crystal Violet Lactone (CVL) | 0.2 |
| Secondary Dye Precursors (mixed) | 0.1 |

Each of the foregoing CF coating formulations results in a CF coating layer of neutral or alkaline character, of acceptable appearance and having the color precursor chromogenic reagent homogeneously distributed there throughout. Such coatings are singularly abrasion and odor free and have been formed of coating weights as low as 0.2 grams/square meter. When used with CB coatings of the type therein described the image forming reaction proceeds without the color precursor chromogenic reagent material in the CF coating being solubilized and ionized the liquid electron accepting chromogenic reagent material emitted from the CB coating.

Having thus described our invention, we claim:

1. A pressure sensitive chemical type transfer medium comprising:

planar sheet material having an at least partially transferable coating layer disposed on one surface thereof constituted by the solidified residue of an applied hot melt low oil content wax base emulsified liquid film including a chemically modified wax-like material having flow agent and dispersant properties homogeneously intermixed therewith and having discrete liquid droplets of a water base solution of an ionized metallic halogen salt electron accepting chromogenic reagent material distributed therein.

2. A pressure sensitive chemical type transfer medium as set forth in claim 1 wherein:

said water base solution of ionized metallic halogen salt electron accepting chromogenic reagent material is selectively displaceable from said coating layer in response to application of pressure to the obverse surface of said planar sheet material.

3. A pressure sensitive chemical type transfer medium as set forth in claim 1 wherein:

the majority of said discrete droplets of the water base solution of an ionized metallic halogen salt electron accepting chromogenic reagent material are homogeneously distributed within the solid coating layer and the majority of which are less than 1 micron in diameter.

4. A pressure sensitive chemical type transfer medium as set forth in claim 1 wherein:

said liquid electron accepting chromogenic reagent material is a concentrated water base solution of a hygroscopic metallic halogen salt selected from the group consisting of zinc chloride, stannous chloride, lithium bromide, ferric chloride and nickel chloride.

5. A pressure sensitive chemical type transfer medium as set forth in claim 4 wherein:

said concentrated water base solution of a metallic halogen salt includes an acidic halogen neutralizing agent therein.

6. A pressure sensitive chemical type transfer medium as set forth in claim 1 wherein:

said discrete droplets of liquid electron accepting chromogenic reagent material consists of a concentrated water base solution of zinc chloride.

7. A pressure sensitive chemical type transfer medium as set forth in claim 6 wherein:

said concentrated water base solution of zinc chloride further includes a relatively small amount of an acidic chloride neutralizing agent selected from a group consisting of ammonium carbonate and ammonium bicarbonate.

8. A pressure sensitive chemical type transfer medium comprising:

planar sheet material having an at least partially transferable coating layer disposed on one surface thereof constituted by the solidified residue of an applied hot melt low oil content wax base emulsified liquid film containing an amine modified synthetic wax flow agent and dispersant as an emulsifying agent therein and having discrete liquid droplets of a water base solution of an ionized metallic halogen salt electron accepting chromogenic reagent material distributed therein.

9. A pressure sensitive chemical type transfer medium as set forth in claim 8 wherein:

the majority of said discrete droplets of the water base solution of an ionized metallic halogen salt electron accepting chromogenic reagent material are homogeneously distributed within the solid coating layer and the majority of which are less than 1 micron in diameter.

10. A pressure sensitive chemical type transfer medium comprising:

a planar sheet material having an at least partially transferable coating disposed on one surface thereof, said transferable coating layer constituted by the solidified residue of an applied hot melt emulsified liquid film comprising a low oil content meltable wax carrier vehicle and a chemically modified wax like flow agent and dispersant homogenously intermixed therewith, and discrete droplets of a concentrated water base solution of ionized hygroscopic metallic halogen salt electron accepting chromogenic reagent material selected from the group consisting of zinc chloride, stannous chloride, lithium bromide, ferric chloride and nickel chloride homogenously distributed therewithin.

11. A pressure sensitive chemical type transfer medium as set forth in claim 10 wherein:

said low oil content meltable wax carrier vehicle is compositely constituted of a major portion of paraffin wax and a minor portion of carnauba wax;

said hygroscopic metallic halogen salt electron accepting chromogenic reagent material is zinc chloride;

and said medium further includes an opacifier and a resinous film forming agent homogenously intermixed in said hot melt emulsified liquid film.

12. A pressure sensitive chemical type transfer medium as set forth in claim 11 wherein:

said concentrated water base solution of zinc chloride further includes a relatively small amount of an acidic chloride neutralizing agent selected from a group consisting of ammonium carbonate and ammonium bicarbonate.

13. A pressure sensitive chemical type transfer medium as set forth in claim 10 wherein said chemically modified wax-like flow agent is selected from the group consisting of the product obtained by reacting a selectively oxidized linear unsaturated hydrocarbon having a terminal carbon double bond with ammonia or a primary organic amine and further reacting the resulting modified hydrocarbon with an isocyanate; the product obtained by reacting an oxidized microcrystalline wax with an isocyanate, the product obtained by reacting an oxidized non-benzenoid wax with an isocyanate; the product obtained by reacting an oxidized microcrystalline wax with ammonia or an amine and further reacting the resulting modified hydrocarbon with an isocyanate and the product obtained by reacting an oxidized non-benzenoid wax with ammonia or an amine and further reacting the resulting modified hydrocarbon with an isocyanate.

14. A pressure sensitive chemical type transfer medium as set forth in claim 10, wherein said planar sheet material has a non-transferable image producing receptor layer on the other surface thereof;

said image receptor layer comprising the solidified residue of an applied alkaline liquid intermixture of an evaporable liquid vehicle, a resinous binder, an opacifier-filler and a water insoluble colorless color precursor as the chromogenic reagent distributed therewithin, said color precursor chromogenic reagent being insoluble in said water base metallic halogen salt solution and being selectively convertible into a color producing condition upon interreaction therewith.

15. A pressure sensitive chemical type transfer medium as set forth in claim 14 wherein:

said color precursor chromogenic reagent material in said image receptor layer comprises a mixture of water insoluble, alkaline stable and acid reacting organic dyestuffs to produce a dark, light stable and enduring image.

16. A pressure sensitive chemical type transfer medium as set forth in claim 14 wherein said chemically modified wax-like flow agent is selected from the group consisting of the product obtained by reacting a selectively oxidized linear unsaturated hydrocarbon having a terminal carbon double bond with ammonia or a primary organic amine and further reacting the resulting modified hydrocarbon with an isocyanate; the product obtained by reacting an oxidized microcrystalline wax with an isocyanate, the product obtained by reacting an oxidized non-benzenoid wax with an isocyanate; the product obtained by reacting an oxidized microcrystalline wax with ammonia or an amine and further reacting the resulting modified hydrocarbon with an isocyanate and the product obtained by reacting an oxidized non-benzenoid wax with ammonia or an amine and further reacting the resulting modified hydrocarbon with an isocyanate.

17. A pressure sensitive chemical type transfer medium comprising:

a planar sheet material having at least partially transferable coating layer disposed on one surface thereof;

said transferable coating layer constituted by the solidified residue of an applied hot melt emulsified film consisting of about 35 to 75% of a meltable low oil content hard wax;

at least 1% to about 15% of a chemically modified wax-like material having flow agent and dispersant properties and about 10 to 35% of an ionized electron accepting metallic halogen salt chromogenic material selected from the group consisting of zinc chloride, stannous chloride, lithium bromide, ferric chloride and nickel chloride dissolved in water to form a concentrated solution thereof.

18. A pressure sensitive chemical type transfer medium as set forth in claim 17 wherein:

said meltable low oil content hard wax is compositely constituted of a major portion of a wax selected from the group consisting of paraffin wax, microcrystalline wax and alpha olefin wax;

said chromogenic material is a concentrated water solution of zinc chloride containing a relatively small amount of an acidic chloride neutralizing agent selected from the group consisting of ammonium carbonate and ammonium bicarbonate.

19. A pressure sensitive chemical type transfer medium as set forth in claim 17 wherein said chemically modified wax-like flow agent is selected from the group consisting of the product obtained by reacting a selectively oxidized linear unsaturated hydrocarbon having a terminal carbon double bond with ammonia or a primary organic amine and further reacting the resulting modified hydrocarbon with an isocyanate; the product obtained by reacting an oxidized microcrystalline wax with an isocyanate, the product obtained by reacting an oxidized non-benzenoid wax with an isocyanate; the product obtained by reacting an oxidized microcrystalline wax with ammonia or an amine and further reacting the resulting modified hydrocarbon with an isocyanate and rhe product obtained by reacting an oxidized non-benzenoid wax with ammonia or an amine and further reacting the resulting modified hydrocarbon with an isocyanate.

20. A pressure sensitive chemical type transfer medium as set forth in claim 17 further including:

at least 2% of a resinous film forming agent; and at least 2% of an isolating agent selected from the group consisting of stearic acid and zinc stearate.

21. A pressure sensitive chemical type transfer medium comprising:

planar sheet material having an at least partially transferable coating layer disposed on one surface thereof, said transferable coating layer constituted by the solidified residue of an applied hot melt emulsified liquid film consisting of about 50 to 60% of a composite meltable low oil content wax carrier vehicle made up from 3 to 4 parts of paraffin wax to 1 part of carnauba wax;

about 2 to 5% of a synthetic chemically modified wax-like material having the properties of a flow agent and dispersant;

about 3 to 10% of a polyethylenic film forming agent;

about 5% of an opacifier-filler;

about 3 to 10% of stearic acid and about 25 to 35% of a concentrated solution of zinc chloride made up of at least 2 parts of zinc chloride to 1 part of water as an electron accepting chromogenic reagent;

said transferable coating layer having emulsified discrete liquid droplets of said concentrated zinc chloride solution distributed therewithin.

22. A pressure sensitive chemical type transfer medium as set forth in claim 21 wherein:

said concentrated solution of zinc chloride further contains a relatively small amount of an acid chloride neutralizing agent selected from the group consisting of ammonium carbonate and ammonium bicarbonate.

23. A pressure sensitive chemical type transfer medium as set forth in claim 21 wherein said chemically modified wax-like flow agent is selected from the group consisting of the product obtained by reacting a selectively oxidized linear unsaturated hydrocarbon having a terminal carbon double bond with ammonia or a primary organic amine and further reacting the resulting modified hydrocarbon with an isocyanate; the product obtained by reacting an oxidized microcrystalline wax with an isocyanate, the product obtained by reacting an oxidized non-benzenoid wax with an isocyanate; the product obtained by reacting an oxidized microcrystalline wax with ammonia or an amine and further reacting the resulting modified hydrocarbon with an isocyanate and the product obtained by reacting an oxidized non-benzenoid wax with ammonia or an amine and further reacting the resulting modified hydrocarbon with an isocyanate.

24. A pressure sensitive chemical type transfer medium as set forth in claim 21, wherein:

the majority of said emulsified liquid droplets of concentrated zinc chloride solution are less than 1 micron in diameter.

* * * * *